US009072645B2

(12) United States Patent
Gamman et al.

(10) Patent No.: US 9,072,645 B2
(45) Date of Patent: Jul. 7, 2015

(54) HEIGHT ADJUSTMENT MECHANISM FOR A MASSAGE TABLE

(75) Inventors: Dave Gamman, Oceanside, CA (US); Jon W. Roleder, San Diego, CA (US)

(73) Assignee: EARTHLITE MASSAGE TABLES, INC., Vista, CA (US)

( * ) Notice: Subject to any disclaimer, the term of this patent is extended or adjusted under 35 U.S.C. 154(b) by 860 days.

(21) Appl. No.: 13/227,383

(22) Filed: Sep. 7, 2011

(65) Prior Publication Data

US 2012/0060291 A1 Mar. 15, 2012

Related U.S. Application Data

(60) Provisional application No. 61/380,499, filed on Sep. 7, 2010.

(51) Int. Cl.

| | |
|---|---|
| ***A61G 13/06*** | (2006.01) |
| ***A61G 7/012*** | (2006.01) |
| ***B66F 7/06*** | (2006.01) |
| ***A61G 13/00*** | (2006.01) |

(52) U.S. Cl.

CPC ..... *A61G 13/009* (2013.01); *B66F 7/065* (2013.01); *A61G 7/012* (2013.01); *A61G 13/06* (2013.01)

(58) Field of Classification Search

CPC ..... A61G 7/018; A61G 7/015; A61G 7/012; A61G 7/05; A61G 13/06; A47C 19/05; B66F 7/065; B66F 3/22

USPC ..... 5/611, 600, 11; 254/122

See application file for complete search history.

(56) References Cited

U.S. PATENT DOCUMENTS

| | | | | |
|---|---|---|---|---|
| 2,501,001 | A * | 3/1950 | Neely | 254/122 |
| 2,829,863 | A * | 4/1958 | Gibson | 254/8 C |
| 2,833,587 | A * | 5/1958 | Saunders | 296/20 |
| 3,110,476 | A * | 11/1963 | Farris | 254/122 |

(Continued)

FOREIGN PATENT DOCUMENTS

| | | | |
|---|---|---|---|
| DE | 3037375 | A1 | 5/1982 |
| DE | 29802043 | U1 | 6/1998 |

(Continued)

OTHER PUBLICATIONS

PCT Notification of Transmittal of International Search Report and the Written Opinion for PCT/US2011/050726 (related to the present application), dated Dec. 19, 2011, Earthlite Massage Tables, Inc.

(Continued)

*Primary Examiner* — Robert G Santos
(74) *Attorney, Agent, or Firm* — Roeder & Broder LLP

(57) ABSTRACT

A massage device (10) includes a table top assembly (12) that supports a user above a surface (18). The massage device (10) comprises a leg assembly (14) and an adjuster assembly (16). The leg assembly (14) extends between the table top assembly (12) and the surface (18). Additionally, the leg assembly (14) includes a first leg (24), a second leg (26), and a leg attacher (28) that pivotally secures the first leg (24) to the second leg (26). The adjuster assembly (16) adjusts the position of the table top assembly (12) relative to the surface (18) between a lower position and an upper position. The adjuster assembly (16) includes an adjuster (44) that acts primarily in push mode to pivot the second leg (26) relative to the first leg (24) so that the table top assembly (12) moves between the lower position and the upper position.

18 Claims, 3 Drawing Sheets

(56) References Cited

U.S. PATENT DOCUMENTS

| | | | | | |
|---|---|---|---|---|---|
| 3,237,921 | A * | 3/1966 | Jay | 254/122 |
| 3,282,566 | A * | 11/1966 | Clarke | 254/122 |
| 3,611,453 | A * | 10/1971 | Lokken | 5/610 |
| 3,686,696 | A * | 8/1972 | Lanigan | 5/611 |
| 4,097,941 | A * | 7/1978 | Merkel | 5/86.1 |
| 4,556,198 | A * | 12/1985 | Tominaga | 254/122 |
| 4,558,648 | A * | 12/1985 | Franklin et al. | 108/147 |
| 4,577,821 | A * | 3/1986 | Edmo et al. | 108/145 |
| 4,613,122 | A * | 9/1986 | Manabe | 5/601 |
| 4,771,785 | A * | 9/1988 | Duer | 600/415 |
| 4,860,394 | A * | 8/1989 | Benessis et al. | 5/611 |
| 4,984,774 | A * | 1/1991 | Zupancic et al. | 5/601 |
| 5,022,105 | A * | 6/1991 | Catoe | 5/11 |
| 5,074,000 | A * | 12/1991 | Soltani et al. | 5/611 |
| 5,490,703 | A * | 2/1996 | Hewko | 296/19 |
| 5,588,377 | A | 12/1996 | Fahmian | |
| 5,779,296 | A * | 7/1998 | Hewko | 296/19 |
| 6,199,508 | B1 * | 3/2001 | Miale et al. | 119/28.5 |
| 6,230,662 | B1 * | 5/2001 | Miale et al. | 119/727 |
| 6,516,478 | B2 * | 2/2003 | Cook et al. | 5/611 |
| 6,729,263 | B2 * | 5/2004 | Miale et al. | 119/28.5 |
| 7,140,055 | B2 * | 11/2006 | Bishop et al. | 5/611 |
| 7,694,367 | B2 * | 4/2010 | Zakrzewski | 5/611 |
| 8,015,638 | B2 * | 9/2011 | Shimada et al. | 5/611 |
| 8,888,070 | B2 * | 11/2014 | Olesen | 254/9 C |
| 2001/0003969 | A1 * | 6/2001 | Miale et al. | 119/28.5 |
| 2002/0178501 | A1 * | 12/2002 | Cook et al. | 5/611 |
| 2003/0079288 | A1 * | 5/2003 | Cook et al. | 5/611 |
| 2005/0125900 | A1 * | 6/2005 | Bishop et al. | 5/618 |
| 2008/0047068 | A1 * | 2/2008 | Zakrzewski | 5/611 |
| 2010/0257671 | A1 * | 10/2010 | Shimada et al. | 5/611 |
| 2012/0060291 | A1 * | 3/2012 | Gamman et al. | 5/611 |
| 2013/0341984 | A1 * | 12/2013 | Olesen | 297/344.15 |
| 2014/0184225 | A1 * | 7/2014 | Xue et al. | 324/321 |
| 2014/0325759 | A1 * | 11/2014 | Bly et al. | 5/611 |
| 2015/0000034 | A1 * | 1/2015 | Geng | 5/11 |

FOREIGN PATENT DOCUMENTS

| | | | | |
|---|---|---|---|---|
| DE | 202006014884 | U1 | 12/2006 | |
| WO | WO 9111979 | A1 * | 8/1991 | A61G 7/005 |

OTHER PUBLICATIONS

PCT International Preliminary Report on Patentability for PCT/US2011/050726 (related to the present application), dated Mar. 21, 2013, Earthlite Massage Tables, Inc.

* cited by examiner

HEIGHT ADJUSTMENT MECHANISM FOR A MASSAGE TABLE

RELATED INVENTION

This application claims priority on U.S. Provisional Application Ser. No. 61/380,499, filed Sep. 7, 2010 and entitled "HEIGHT ADJUSTMENT MECHANISM FOR A MASSAGE TABLE". As far as permitted, the contents of U.S. Provisional Application Ser. No. 61/380,499 are incorporated herein by reference.

BACKGROUND

As the benefits of therapeutic massage are becoming more widely appreciated, more and more people are participating in therapeutic massage. A typical massage table allows the patient to be resting while receiving a massage. Important features for massage tables include high strength in the lateral and vertical directions, light weight, quiet operation, stability, rigidity, and ease and speed of set-up and adjustment.

SUMMARY

The present invention is directed to a massage device including a table top assembly that supports a user above a surface. In certain embodiments, the massage device comprises a leg assembly and an adjuster assembly. The leg assembly extends between the table top assembly and the surface. Additionally, the leg assembly includes a first leg, a second leg, and a leg attacher that pivotally secures the first leg to the second leg. The adjuster assembly adjusts the position of the table top assembly relative to the surface between a lower position and an upper position. The adjuster assembly includes an adjuster that acts primarily in push mode to pivot the second leg relative to the first leg so that the table top assembly moves between the lower position and the upper position.

In one embodiment, the adjuster assembly is positioned substantially adjacent to the table top assembly.

Additionally, in some embodiments, the adjuster assembly further includes an adjuster frame that is secured to the table top assembly. In such embodiments, the adjuster is slidingly coupled to the adjuster frame. Further, in one embodiment, the adjuster includes a first slider and the adjuster frame includes a first slider receiver. In such embodiment, the first slider slides relative to and is guided by the first slider receiver. Additionally, the leg assembly can be coupled to the first slider so that movement of the first slider within the first slider receiver results in movement of the leg assembly relative to the table top assembly. In one embodiment, the adjuster includes a second slider and the adjuster frame includes a second slider receiver. In such embodiment, the second slider slides relative to and is guided by the second slider receiver. Moreover, the second slider can be mechanically linked to the first slider such that movement of the first slider within the first slider receiver results in movement of the second slider within the second slider receiver.

Further, in one embodiment, the first leg includes a first leg top that is fixedly coupled to the table top assembly. Additionally, in such embodiment, the second leg includes a second leg top that is coupled to the second slider. Moreover, in such embodiment, the second leg top moves relative to the first leg top when the table top assembly moves between the upper position and the lower position.

Additionally, in certain embodiments, the adjuster is an actuator that utilizes piston-like movement to move the table top assembly between the upper position and the lower position.

In one embodiment, the adjuster moves in a substantially horizontal, linear direction to move the table top assembly in a substantially vertical direction between the upper position and the lower position.

Further, in one embodiment, the first leg includes a first leg bottom and the second leg includes a second leg bottom. In such embodiment, at least one of the first leg bottom and the second leg bottom moves relative to the surface when the table top assembly moves between the upper position and the lower position.

Still further, in one embodiment, the adjuster assembly includes an adjuster activator that activates the adjuster to move the table top assembly between the upper position and the lower position.

Moreover, in some embodiments, the table top assembly is maintained substantially parallel to the surface during movement between the upper position and the lower position.

Additionally, in certain embodiments, the present invention is further directed to a method for supporting a user of a massage device above a surface. In such embodiments, the method comprising the steps of extending a leg assembly between the table top assembly and the surface, the leg assembly including a first leg and a second leg; pivotally securing the first leg to the second leg with a leg attacher; and adjusting the position of the table top assembly relative to the surface between a lower position and an upper position with an adjuster, the adjuster acting primarily in push mode to pivot the second leg relative to the first leg so that the table top assembly moves between the lower position and the upper position.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1B:
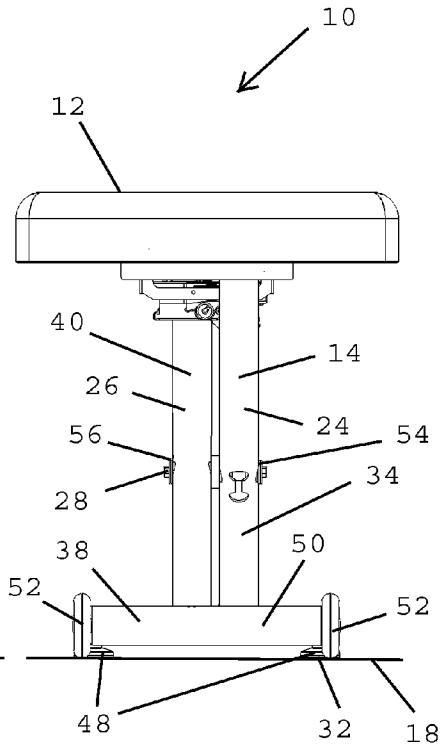
FIG. 1B is a simplified end view of the massage device illustrated in FIG. 1A.
Figure 1A:
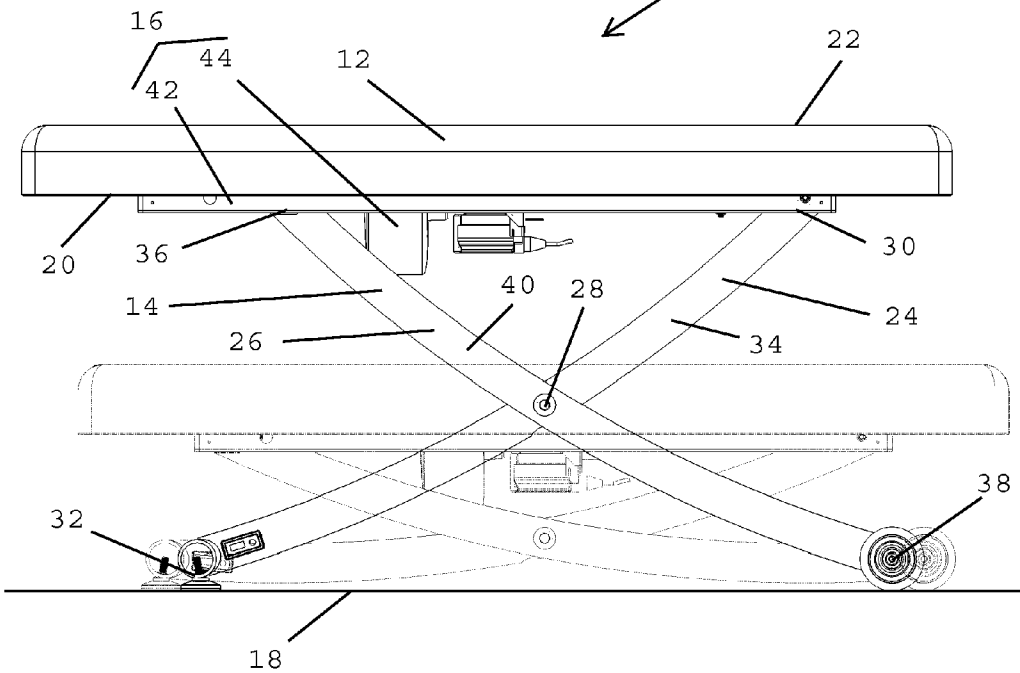
FIG. 1A is a simplified side view of an embodiment of a massage device having features of the present invention.

FIG. 1A is a simplified side view of an embodiment of a massage device 10, i.e. a massage table, having features of the present invention. In this embodiment, the massage device 10 includes a table top assembly 12, a leg assembly 14, and an adjuster assembly 16. The design of these components can be varied to achieve the desired shape, weight, strength and adjustability characteristics of the massage device 10. It should further be noted that although the massage device 10 illustrated herein is a massage table, the invention is equally applicable to another type of table or piece of furniture where quick, easy and reliable height adjustment is desirable.

As an overview, in certain embodiments, the leg assembly 14 is uniquely adjustable via the adjuster assembly 16 so that the height of the table top assembly 12 can be quickly, easily and quietly adjusted relative to a surface 18, e.g., a floor or the ground. In particular, the leg assembly 14 can be selectively adjusted by the adjuster assembly 16 so that the table top assembly 12 can be moved up and down between an upper position (as illustrated in solid lines in FIG. 1A) and a lower position (as illustrated in phantom in FIG. 1A). Moreover, the leg assembly 14 can be adjusted to position the table top assembly 12 anywhere along the continuum between the upper position and the lower position.

Additionally, in some embodiments, the massage device 10 is strong enough that the height of the table top assembly 12 relative to the surface 18 can be adjusted while supporting a person above the surface 18. For example, the massage device 10 has improved strength characteristics such that the table top assembly 12 can be moved from the lower position to the upper position and back when a person, e.g., a handicapped person, is positioned on the table top assembly 12 of the massage device 10. This capability enables such a person to have an improved life because it better enables the person to engage in activities such as massages and/or other treatments. Further, in certain embodiments, the massage device 10 is light weight enough that the massage device 10 is portable while still maintaining the necessary stability and rigidity characteristics to ensure for a relaxing massage.

The table top assembly 12 provides a surface for a person to rest on during a massage. As illustrated in this embodiment, the table top assembly 12 can be generally rectangular shaped. Alternatively, for example, the table top assembly 12 can be another shape, such an oval shape, an oblong shape, or a rectangular shape with one or more rounded corners.

In one embodiment, the table top assembly 12 includes a table frame 20, a pad (not shown), and a covering 22. Alternatively, for example, the table top assembly 12 can be made without the pad and/or without the covering 22.

The table frame 20 supports the person receiving the massage when the person is positioned on the massage device 10. The table frame 20 is generally rigid and can be made of a rigid material such wood, aluminum, steel, plastic or other suitable materials. In alternative, non-exclusive embodiments, the table frame 20 has a thickness of approximately 0.2, 0.3, 0.4, 0.5, 0.6, 0.7, 0.8, or 1 inches. However, other thicknesses can be utilized.

The pad is secured to and can be positioned substantially on top of the table frame 20. Additionally, the pad provides a cushion for the comfort of the person resting on the massage device 10. Non-exclusive examples of suitable materials for the pad include foam, memory foam, fleece pads, etc.

The covering 22 secures the pad to the table frame 20 and provides a protective covering for the pad. Non-exclusive examples of suitable materials for the covering 22 include leather, plastic, and cloth.

In certain embodiments, the table top assembly 12 can further include a headrest (not illustrated) which provides a place to rest the head of the person receiving the massage. In one embodiment, the headrest can be selectively attached to one end of the table top assembly 12. Alternatively, in one embodiment, the headrest can be integrated within the table top assembly 12.

The leg assembly 14 extends between the table top assembly 12 and the surface 18 to maintain the table top assembly 12 positioned above and away from the surface 18. The design of the leg assembly 14 can be varied to suit the specific requirements of the massage device 10. In the embodiment illustrated in FIG. 1A, the leg assembly 14 includes a first leg 24, a second leg 26, and a leg attacher 28. As illustrated, the leg assembly 14 provides scissors-type movement between the first leg 24 and the second leg 26 when the table top assembly 12 is being moved between the upper position and the lower position. Further, as illustrated in this embodiment, the table top assembly 12 can be maintained in a substantially horizontal orientation, i.e. substantially parallel to the surface 18, at all times during movement between the upper position and the lower position. Alternatively, the leg assembly 14 can be designed to provide a different type of relative movement between the first leg 24 and the second leg 26 when the table top assembly 12 is moved between the upper position and the lower position. Still alternatively, the leg assembly 14 can be designed to include greater than or less than two legs.

It should be noted that the use of the terms "first leg" and "second leg" is merely for ease of discussion, and either of the legs can be referred to as the first leg and/or the second leg.

The first leg 24 includes a first leg top 30, a first leg bottom 32, and a first leg body 34. As illustrated in this embodiment, the first leg top 30 can be fixedly coupled to the adjuster assembly 16 and/or to the table top assembly 12. In certain alternative embodiments, the first leg top 30 can be movingly coupled to the adjuster assembly 16 and/or to the table top assembly 12.

The first leg bottom 32 is positioned adjacent to and/or in contact with the surface 18. In the embodiment illustrated in FIG. 1A, the first leg bottom 32 maintains a substantially static contact point with the surface 18 at all times, even during movement of the table top assembly 12 between the upper position and the lower position. It should be noted that although FIG. 1A appears to show movement of the first leg bottom 32 relative to the surface 18, this is merely for purposes of clarity in illustrating the relative lateral movement of the various features of the massage device 10 relative to the leg attacher 28 (which is shown as moving only vertically and not laterally). In alternative embodiments, the first leg bottom 32 can be designed to move relative to the surface 18 when the table top assembly 12 is moved between the upper position and the lower position.

The first leg body 34 extends at an angle between the first leg top 30 and the first leg bottom 32. Further, as illustrated, the first leg body 34 can be slightly curved to provide improved strength characteristics. In one embodiment, the first leg body 34 is substantially cylindrical tube shaped, and the first leg body 34 can be made from a substantially rigid material such as metal or aluminum. Alternatively, the first leg body 34 can have a different design and/or can be made from a different material.

The second leg 24 includes a second leg top 36, a second leg bottom 38, and a second leg body 40. As illustrated in this embodiment, the second leg top 36 can be movingly coupled to the adjuster assembly 16 and/or to the table top assembly 12. In certain alternative embodiments, the second leg top 36 can be fixedly coupled to the adjuster assembly 16 and/or to the table top assembly 12.

The second leg bottom 38 is positioned adjacent to and/or in contact with the surface 18. In the embodiment illustrated in FIG. 1A, the second leg bottom 38 is adapted to move relative to the surface 18 when the table top assembly 12 is being moved between the upper position and the lower position. In alternative embodiments, the second leg bottom 38 can be designed to maintain a substantially static position relative to the surface 18 when the table top assembly 12 is moved between the upper position and the lower position.

In one embodiment, the first leg bottom 32 and the second leg bottom 38 can be positioned approximately 54.50 inches apart along the surface 18 when the table top assembly 12 is in the upper position, and the first leg bottom 32 and the second leg bottom 38 can be positioned approximately 59.50 inches apart along the surface 18 when the table top assembly 12 is in the lower position. Stated another way, in such embodiment, the first leg bottom 32 and the second leg bottom 38 can be moved approximately five inches relative to one another along the surface 18 when the table top assembly 12 is moved between the upper position and the lower position. Alternatively, the spacing between the first leg bottom 32 and the second leg bottom 38 can be different when the table top assembly 12 is in the upper position and/or when the table top assembly 12 is in the lower position. Still alternatively, the first leg bottom 32 and the second leg bottom 38 can be moved more than five inches or less than five inches relative to one another along the surface 18 when the table top assembly 12 is moved between the upper position and the lower position.

The second leg body 40 extends at an angle between the second leg top 36 and the second leg bottom 38. Further, as illustrated, the second leg body 40 can be slightly curved to provide improved strength characteristics. In one embodiment, the second leg body 40 is substantially cylindrical tube shaped, and the second leg body 40 can be made from a substantially rigid material such as metal or aluminum. Alternatively, the second leg body 40 can have a different design and/or can be made from a different material.

The leg attacher 28 movably, e.g., pivotally and/or slidingly, secures the first leg 24 to the second leg 26. In the embodiment illustrated in FIG. 1A, the leg attacher 28 pivotally attaches the first leg 24 to the second leg 26 while still allowing a scissors-type movement between the first leg 24 and the second leg 26 when the table top assembly 12 is moved between the upper position and the lower position. In one embodiment, the leg attacher 28 can include a pin or a screw that extends through a first leg aperture 54 (illustrated in FIG. 1B) in the first leg 24 and through a second leg aperture 56 (illustrated in FIG. 1B) in the second leg 26 to allow the first leg 24 and the second leg 26 to pivot relative to one another. Alternatively, the leg attacher 28 can have a different design. Additionally and/or alternatively, in one embodiment, the first leg 24 can include a first leg slot (not illustrated) and/or the second leg 26 can include a second leg slot (not illustrated). In such embodiment, the leg attacher 28 can extend through or be positioned within the first slot and/or the second slot to enable the first leg to slide and/or pivot relative to one another.

Further, the leg attacher 28 can be positioned so that the first leg 24 is secured to the second leg 26 along the first leg body 34 between the first leg top 30 and the first leg bottom 32. For example, in one embodiment, as illustrated in FIG. 1A, the first leg 24 can be secured to the second leg 26 by the leg attacher 28 along the first leg body 34 approximately half way between the first leg top 30 and the first leg bottom 32. Alternatively, the leg attacher 28 can be positioned so that the first leg 24 is secured to the second leg 26 at a different point along the first leg body 34 between the first leg top 30 and the first leg bottom 32.

Similarly, the leg attacher 28 can be positioned so that the second leg 26 is secured to the first leg 24 along the second leg body 40 between the second leg top 36 and the second leg bottom 38. For example, in one embodiment, as illustrated in FIG. 1A, the second leg 26 can be secured to the first leg 24 by the leg attacher 28 along the second leg body 40 approximately half way between the second leg top 36 and the second leg bottom 38. Alternatively, the leg attacher 28 can be positioned so that the second leg 26 is secured to the first leg 24 at a different point along the second leg body 40 between the second leg top 36 and the second leg bottom 38.

The adjuster assembly 16 adjusts the position of the table top assembly 12 between the upper position and the lower position. Additionally, the adjuster assembly 16 can adjust the position of the table top assembly 12 to be anywhere along the continuum between the upper position and the lower position to suit the comfort of the person receiving the massage. Further, in certain embodiments, as noted above, the table top assembly 12 can be maintained in a substantially horizontal orientation, i.e. substantially parallel to the surface 18, at all times during movement between the upper position and the lower position.

In one embodiment, the table top assembly 12 can be moved between the upper position, wherein the table top assembly 12 is positioned approximately 36.50 inches above the surface 18, and the lower position, wherein the table top assembly 12 is positioned approximately 17.75 inches above the surface 18. Stated another way, in such embodiment, the table top assembly 12 can have a vertical range of motion of approximately 18.75 inches between the upper position and the lower position. Alternatively, the position of the table top assembly 12 relative to the surface 18 can be adjusted such that each of the upper position and the lower position are greater than or less than the distances stated above. Still alternatively, the table top assembly 12 can have a vertical range of motion that is greater than or less than approximately 18.75 inches. During movement between the positions, the legs 24, 26 pivot relative to each other.

In this embodiment, as will be described in greater detail below, the adjuster assembly 16 includes an adjuster frame 42 and an adjuster 44 that are secured to and/or positioned substantially adjacent to the table top assembly 12. In particular, as illustrated in FIG. 1A, the adjuster frame 42 and the adjuster 44 can be secured to and/or positioned substantially adjacent to the table frame 20 of the table top assembly 12.

Additionally, in this embodiment, the first leg top 30 is fixedly coupled to the adjuster frame 42 of the adjuster assembly 16. In certain alternative embodiments, the first leg top 30 can be movingly coupled to the adjuster frame 42 of the adjuster assembly 16.

Further, in this embodiment, the second leg top 36 is movingly coupled to the adjuster frame 42 of the adjuster assembly 16. In certain alternative embodiments, the second leg top 36 can be fixedly coupled to the adjuster frame 42 of the adjuster assembly 16.

FIG. 1B is a simplified end view of the massage device 10 illustrated in FIG. 1A. In particular, FIG. 1B illustrates further details of the leg assembly 14.

In this embodiment, the first leg bottom 32 includes a substantially cylindrical tube shaped first cross member 46 (illustrated in FIG. 2) and a pair of circular disk shaped base members 48 that are secured at or near either end of the first cross member 46. The base members 48 are designed to maintain a substantially static contact point between the first leg 24 and the surface 18 at all times, even during movement of the table top assembly 12 between the upper position and the lower position.

Further, in this embodiment, the second leg bottom 38 includes a substantially cylindrical tube shaped second cross member 50 and a pair of circular rollers 52 that are secured at or near either end of the second cross member 50. The rollers 52 are designed to allow the second leg 26 to move relative to the surface 18 when the table top assembly 12 is moved between the upper position and the lower position.

As stated above, the leg attacher 28 pivotally secures the first leg 24 to the second leg 26. Additionally, as illustrated in this embodiment, the first leg body 34 includes the first leg aperture 54 for receiving the leg attacher 28, and the second leg body 40 includes the second leg aperture 56 for receiving the leg attacher 28. In this embodiment, the leg attacher 28 includes a screw that extends through each of the first leg aperture 54 and the second leg aperture 56, and a plurality of nuts and washers to secure and maintain the screw within the first leg aperture 54 and the second leg aperture 56. Alternatively, the leg attacher 28 can have a different design. Still alternatively, as noted above, one or both of the first leg body 34 and the second leg body 40 can include a slot that slidingly receives the leg attacher 28.

Figure 2:
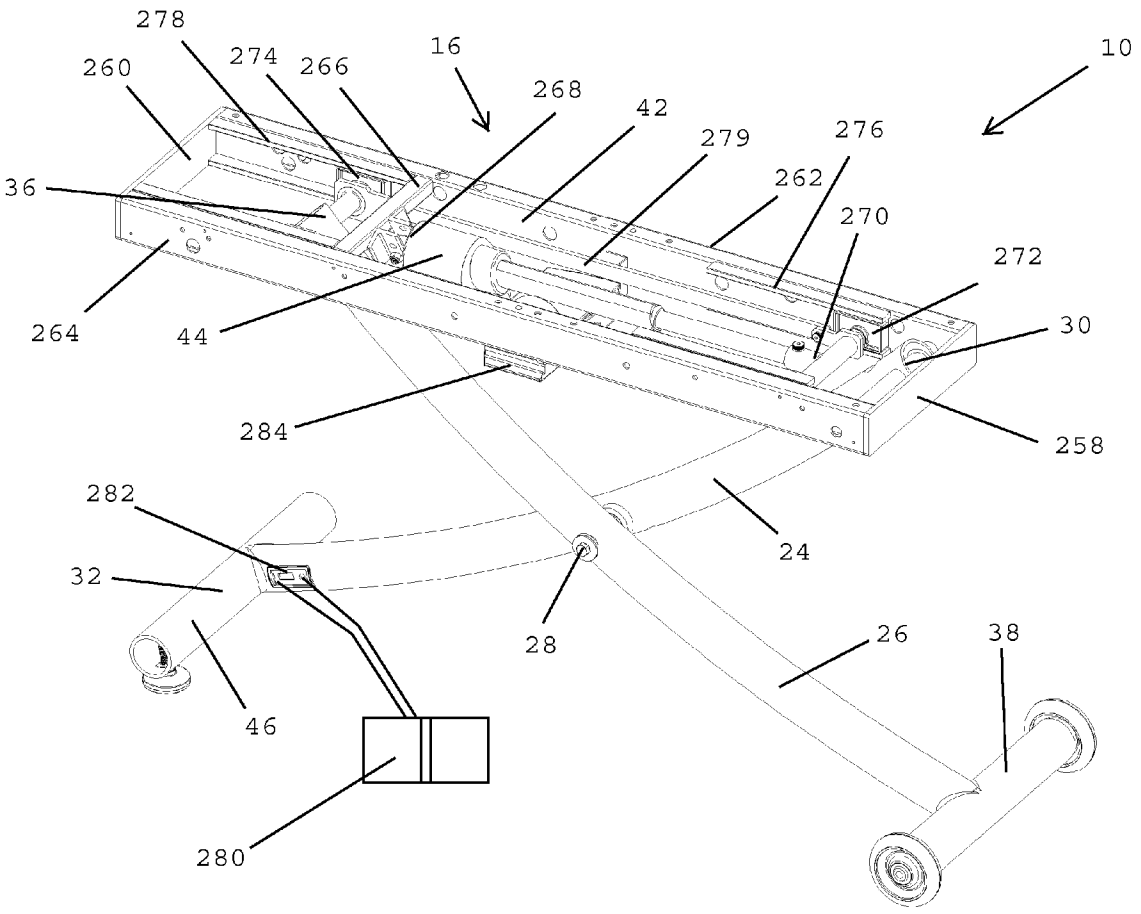
FIG. 2 is a perspective view of a portion of the massage device illustrated in FIG. 1A.

FIG. 2 is a perspective view of a portion of the massage device 10 illustrated in FIG. 1A. In particular, FIG. 2 is a perspective view of the massage device 10 with the table top assembly 12 removed for purposes of clarity.

As provided above, the adjuster assembly 16 adjusts the position of the table top assembly 12 (illustrated in FIG. 1A) relative to the surface 18 (illustrated in FIG. 1A) between the upper position and the lower position, or anywhere along the continuum between the upper position and the lower position. The design of the adjuster assembly 16 can be varied to suit the specific requirements of the massage device 10. As illustrated in FIG. 2, the adjuster assembly 16 includes the adjuster frame 42 and the adjuster 44.

As noted above, the adjuster frame 42 is secured to and/or positioned substantially adjacent to the table frame 20 (illustrated in FIG. 1A) of the table top assembly 12. In this embodiment, the adjuster frame 42 is generally rectangle shaped, including a first frame end 258, an opposed second frame end 260, a first frame side 262, an opposed second frame side 264, and an adjuster attacher 266 that extends generally between the first frame side 262 and the second frame side 264. Alternatively, the adjuster frame 42 can be designed with a different shape. Additionally, the adjuster frame 42 is generally rigid and can be made of a rigid material such wood, aluminum, metal, plastic or other suitable materials.

Further, as noted above, the adjuster 44 is secured to and/or positioned substantially adjacent to the table frame 20 of the table top assembly 12. In the embodiment illustrated in FIG. 2, the adjuster 44 is coupled to the adjuster attacher 266 of the adjuster frame 42. In certain embodiments, the adjuster 44 is an actuator, e.g., a hydraulic actuator that is electrically activated, that utilizes piston-like movement to move the table top assembly 12 between the upper position and the lower position. Alternatively, the adjuster can have a different design. For example, the adjuster 44 can be an electronic actuator, a pneumatic actuator or another type of actuator.

Additionally, as illustrated, the adjuster 44 is oriented such that the piston-like movement of the adjuster 44 is in a substantially horizontal, linear direction. Further, in one embodiment, the adjuster 44 acts primarily in the push mode. For example, in such embodiment, the adjuster 44 acts in push mode when the adjuster 44 moves, i.e. lifts, the table top assembly 12 in a generally upward direction, e.g., from the lower position toward the upper position. Thus, the adjuster 44 moves, e.g., pushes, in a horizontal, linear direction to move the table top assembly 12 vertically between the lower position and the upper position. It should be noted that having the adjuster 44 move in a purely linear fashion inhibits damage to the adjuster 44 that may be caused by any non-linear movement that may generate undesired torque and/or other forces on the adjuster 44.

With the design and positioning of the adjuster 44 as noted, the massage device 10 is better able to support and adjust the height of the table top assembly 12, and thus support and adjust the height of the person receiving the massage, without any resulting damage to the adjuster 44. It should be noted, in certain embodiments, that the adjuster 44 is somewhat stronger when utilized in push mode. For example, in one such embodiment, the adjuster 44 can be somewhat stronger when utilized in push mode as a result of the smaller surface area of the piston due to the presence of a piston shaft being connected to one side of the piston. Moreover, with this design, as noted above, the adjuster 44 pushes substantially linearly so as to enhance the durability of the adjuster 44. In certain alternative embodiments, the adjuster 44 can be coupled to the table top assembly 10 in a different manner, can have a different design and/or can act primarily in a different mode. For example, in one such alternative embodiment, the adjuster 44 can act primarily in pull mode.

In the embodiment illustrated in FIG. 2, the adjuster assembly 16 also includes a first adjuster end 268, a second adjuster end 270, a pair of first sliders 272 (only one first slider is visible in FIG. 2) and a pair of second sliders 274 (only one second slider is visible in FIG. 2). Additionally, in the embodiment illustrated in FIG. 2, the adjuster frame 42 further includes a pair of first slider receivers 276 (only one first slider receiver is visible in FIG. 2) and a pair of second slider receivers 278 (only one second slider receiver is visible in FIG. 2). One first slider receiver 276 is secured to and/or positioned substantially adjacent to the first frame side 262 near the first frame end 258, and the other first slider receiver 276 is secured to and/or positioned substantially adjacent to the second frame side 264 near the first frame end 258. Somewhat similarly, one second slider receiver 278 is secured to and/or positioned substantially adjacent to the first frame side 262 near the second frame end 260, and the other second slider receiver 278 is secured to and/or positioned substantially adjacent to the second frame side 264 near the second frame end 260. In certain alternative embodiments, the adjuster assembly 16 can be designed to include more or less than two first sliders 272 and/or more or less than two second sliders 274. Further, in certain alternative embodiments, the adjuster frame 42 can be designed to include more or less than two first slider receivers 276 and/or more or less than two second slider receivers 278.

The first adjuster end 268 is coupled to the adjuster attacher 266 of the adjuster frame 42. Further, the second adjuster end 270 is slidingly coupled to the adjuster frame 42 via the first sliders 272 and the first slider receivers 276. More particularly, each of the first sliders 272 is secured near the second adjuster end 270 and slides relative to and is guided by one the first slider receivers 276 of the adjuster frame 42. With this design, as illustrated, each of the first sliders 272 is constrained to move back and forth along a substantially horizontal axis within one of the first slider receivers 276. Moreover, movement of the second adjuster end 270 results in the corresponding movement of the first sliders 272 within the first slider receivers 276.

Each of the second sliders 274 is secured at or near the second leg top 36 of the second leg 26. Stated another way, the second leg top 36 is slidingly coupled to the adjuster frame 42 via the second sliders 274 and the second slider receivers 278. Each of the second sliders 274 is adapted to be received within and slides relative to and is guided by one of the second slider receivers 278 of the adjuster frame 42. With this design, as illustrated, each of the second sliders 274 is constrained to move back and forth along a substantially horizontal axis within one of the second slider receivers 278. Moreover, movement of the second sliders 274 within the second slider receivers 278 results in the corresponding movement of the second leg top 36, and thus the second leg 26, relative to the adjuster frame 42.

Still further, in this embodiment, the second sliders 274 are mechanically linked via a linkage assembly 279 to the first sliders 272, such that movement of the first sliders 272 within the first slider receivers 276 results in movement in the same direction of the second sliders 274 within the second slider receivers 278.

It should be noted that in FIG. 2, the massage device 10, i.e. the table top assembly 12, is illustrated in the upper position. As shown in FIG. 2, when the table top assembly 12 is in the upper position, the first sliders 272 are positioned at or near an end of the first slider receivers 276 substantially adjacent to the first leg top 30 of the first leg 24 and/or substantially adjacent to the first frame end 258. Additionally, when the table top assembly 12 is in the upper position, the second sliders 274 are positioned at or near an end of the second slider receivers 278 substantially adjacent to the adjuster attacher 266.

Conversely, when the table top assembly 12 is in the lower position, the first sliders 272 are positioned at or near an end of the first slider receivers 276 away from the first leg top 30 of the first leg 24 and/or away from the first frame end 258. Additionally, when the table top assembly 12 is in the lower position, the second sliders are positioned at or near an end of the second slider receivers 278 away from the adjuster attacher 266 and/or substantially adjacent to the second frame end 260.

Additionally, in this embodiment, the adjuster assembly 16 further includes an adjuster activator 280, an activator outlet 282, and a power source 284. The adjuster activator 280 is electrically connected to the power source 284 via the activator outlet 282. For example, in this embodiment, the adjuster activator 280 is a foot pedal that the operator can manipulate by stepping down or otherwise pushing on one side or the other to activate the adjuster 44 to move the table top assembly 12 in a generally upward or generally downward direction. Alternatively, the adjuster activator 280 can have a different design. For example, the adjuster activator 280 can be a hand-held mechanism and/or the adjuster activator 280 can include one or more buttons or switches to activate the adjuster 44.

During use, in one embodiment, if the operator wants to move the table top assembly 12 in a generally downward direction toward the lower position, the operator can step down on or otherwise push on one side of the adjuster activator 280. By stepping down on or otherwise pushing on this side of the adjuster activator 280, the adjuster 44 is activated such that the adjuster will contract thereby pulling the first sliders 272 such that the first sliders 272 slide within the first slider receivers 276 away from the first frame end 258 of the adjuster frame 42. Because the first sliders 272 are mechanically linked to the second sliders 274, as described above, this movement of the first sliders 272, in turn, pushes the second sliders 274 away from the adjuster attacher 266 and toward the second frame end 260 of the adjuster frame 42. This movement of the second sliders 274 toward the second frame end 260 of the adjuster frame 42 results in the corresponding movement of the second leg top 36 of the second leg 26 toward the second frame end 260 of the adjuster frame 42 and away from the first leg top 30. Thus, since (i) the second leg 26 is movably secured to the first leg 24 via the leg attacher 28, (ii) the first leg top 30 of the first leg 24 is fixedly coupled to the adjuster assembly 16 and/or the table top assembly 12, and (iii) the first leg bottom 32 is in static contact with the surface 18, the movement of the second leg top 36 toward the second frame end 260 of the adjuster frame 42 (i.e. away from the first leg top 30) results in corresponding movement of the second leg bottom 38 along the surface 18 away from the first leg bottom 32. Accordingly, the movement of the second leg top 36 away from the first leg top 30 and the movement of the second leg bottom 38 away from the first leg bottom 32, thereby results in generally downward movement of the table top assembly 12 toward the lower position.

Conversely, during use, if the operator wants to move the table top assembly 12 in a generally upward direction toward the upper position, the operator can step down on or otherwise push on the other side of the adjuster activator 280. By stepping down on or otherwise pushing on the other side of the adjuster activator 280, the adjuster 44 is activated such that the adjuster will essentially expand thereby pushing the first sliders 272 such that the first sliders 272 slide within the first slider receivers 276 toward the first frame end 258 of the adjuster frame 42. Again, because the first sliders 272 are mechanically linked to the second sliders 274, as described above, this movement of the first sliders 272, in turn, pulls the second sliders 274 away from the second frame end 260 of the adjuster frame 42 and toward the adjuster attacher 266. This movement of the second sliders 274 toward the adjuster attacher 266 results in the corresponding movement of the second leg top 36 of the second leg 26 toward the adjuster attacher 266 and toward the first leg top 30. Thus, again, since (i) the second leg 26 is movably secured to the first leg 24 via the leg attacher 28, (ii) the first leg top 30 of the first leg 24 is fixedly coupled to the adjuster assembly 16 and/or the table top assembly 12, and (iii) the first leg bottom 32 is in static contact with the surface 18, the movement of the second leg top 36 toward the adjuster attacher 266 (i.e. toward the first leg top 30) results in corresponding movement of the second leg bottom 38 along the surface toward the first leg bottom 32. Accordingly, the movement of the second leg top 36 toward the first leg top 30 and the movement of the second leg bottom 38 toward the first leg bottom 32, thereby results in generally upward movement of the table top assembly 12 toward the upper position.

Figure 3:
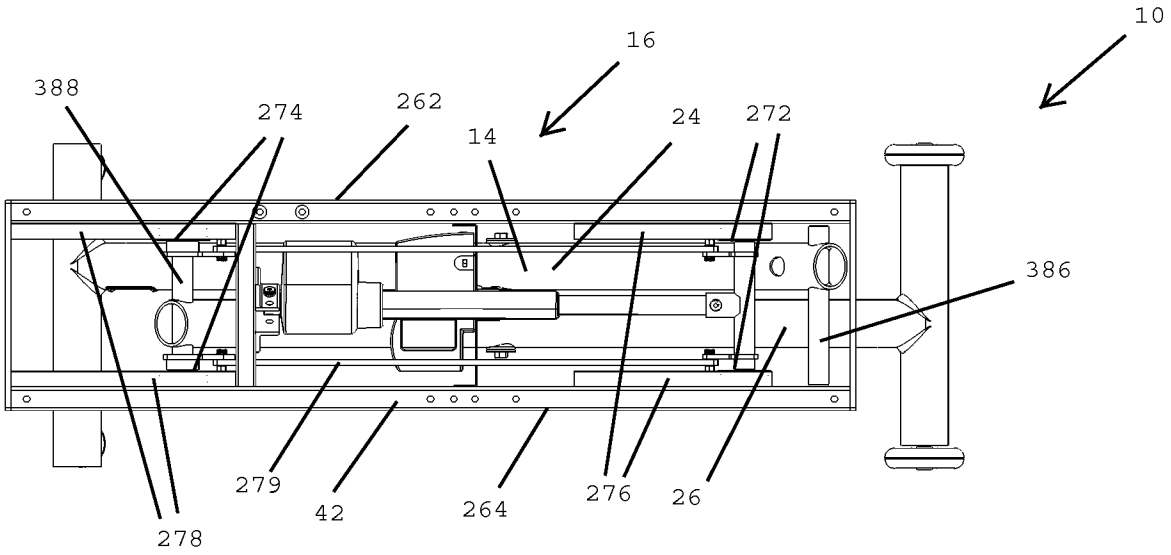
FIG. 3 is a top view of a portion of the massage device illustrated in FIG. 1A.

FIG. 3 is a top view of a portion of the massage device illustrated in FIG. 1A. In particular, FIG. 3 is a top view of the massage device 10 with the table top assembly 12 removed for purposes of clarity.

As shown in the embodiment illustrated in FIG. 3, the leg assembly 14 can further include a first leg attacher 386 and a second leg attacher 388.

The first leg attacher 386 fixedly secures the first leg 24 to the adjuster frame 42. More particularly, in this embodiment, the first leg attacher 386 is substantially cylindrical tube shaped and extends between and fixedly secures the first leg 24 to the first frame side 262 and the second frame side 264. Alternatively, the first leg attacher 386 can have a different shape, a different positioning, and/or can secure the first leg 24 to the adjuster frame 42 in a different manner.

The second leg attacher 388 couples the second leg 26 to the second sliders 274 so that the second leg 26 can be slidingly coupled to the adjuster frame 42. More particularly, in this embodiment, the second leg attacher 388 is substantially cylindrical tube shaped and extends between and couples the second leg 26 to each of the second sliders 274. Alternatively, the second leg attacher 388 can have a different shape, a different positioning, and/or can couple the second leg 26 to the adjuster frame 42 in a different manner.

Additionally, FIG. 3 more clearly illustrates the linkage assembly 279 that mechanically links the first sliders 272 and the second sliders 274 so that movement of the first sliders 272 within the first slider receivers 276 results in movement in the same direction of the second sliders 274 within the second slider receivers 278. The design of the linkage assembly 279 can be varied to suit the specific requirements of the massage device 10 and the adjuster assembly 16. As illustrated in this embodiment, the linkage assembly 279 can include a pair of long slender bars that extend generally between the first leg attacher 386 and the second leg attacher 388, with one bar being positioned near the first frame side 262 and the other bar being positioned near the second frame side 264. Alternatively, the linkage assembly 279 can have a different shape, a different positioning, and/or can mechanically link the first sliders 272 and the second sliders 274 in a different manner.

While a number of exemplary aspects and embodiments of a massage device 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A massage device that supports a user above a surface, the massage device comprising:

a table top assembly that supports the user;

a leg assembly that extends between the table top assembly and the surface, the leg assembly including a first leg, a second leg, and a leg attacher that pivotally secures the first leg to the second leg; and an adjuster assembly that adjusts the position of the table top assembly relative to the surface between a lower position and an upper position, the adjuster assembly including an adjuster that acts in push mode to pivot the second leg relative to the first leg to move the table top assembly from the lower position to the upper position, and acts in pull mode to pivot the second leg relative to the first leg to move the table top assembly from the upper position to the lower position; wherein the adjuster is positioned adjacent to the table top assembly and above the leg attacher in both the lower position and the upper position of the table top assembly; and wherein the adjuster moves in a substantially horizontal, linear direction to move the table top assembly in a substantially vertical direction between the upper position and the lower position.

2. The massage device of claim 1 wherein the adjuster assembly further includes an adjuster frame that is secured to the table top assembly, and a first slider that is slidingly coupled to the adjuster frame; wherein the adjuster selectively slides the first slider relative to the adjuster frame.

3. The massage device of claim 2 wherein the adjuster assembly includes a second slider that slides relative to the table top assembly, the second slider being spaced apart from and mechanically linked to the first slider so that the second slider slides concurrently with the first slider, and wherein the adjuster is positioned between the first slider and the second slider.

4. The massage device of claim 3 wherein the first leg includes a first leg top that is pivotably coupled to the table top assembly, wherein the second leg includes a second leg top that is coupled to the second slider so that the second leg top slides relative to the table top assembly, and wherein the second leg top moves relative to the first leg top when the table top assembly moves between the upper position and the lower position.

5. The massage device of claim 3 wherein both the first slider and the second slider are positioned adjacent to the table top assembly and above the leg attacher in both the lower position and the upper position of the table top assembly.

6. The massage device of claim 5 wherein the adjuster pushes the first slider in a substantially horizontal, linear direction so that the first slider pulls the second slider to move the table top assembly in a substantially vertical upward direction from the lower position to the upper position, and the adjuster pulls the first slider in a substantially horizontal, linear direction so that the first slider pushes the second slider to move the table top assembly in a substantially vertical downward direction from the upper position to the lower position.

7. The massage device of claim 1 wherein the adjuster is an actuator that utilizes piston-like movement to move the table top assembly between the upper position and the lower position.

8. The massage device of claim 1 wherein the first leg includes a first leg bottom and the second leg includes a second leg bottom, and wherein at least one of the first leg bottom and the second leg bottom moves relative to the surface when the table top assembly moves between the upper position and the lower position.

9. The massage device of claim 1 wherein the table top assembly is maintained substantially parallel to the surface during movement between the upper position and the lower position.

10. A method for supporting a user of a massage device above a surface, the method comprising the steps of:

supporting the user with a table top assembly;

extending a leg assembly between the table top assembly and the surface, the leg assembly including a first leg and a second leg;

pivotally securing the first leg to the second leg with a leg attacher;

coupling a first slider to the table top assembly, the first slider sliding relative to the table top assembly;

coupling a second slider to the table top assembly spaced apart from the first slider, the second slider sliding relative to the table top assembly, the second slider coupling the second leg to the table top assembly;

mechanically linking the first slider to the second slider so that the second slider moves concurrently with the first slider;

adjusting the position of the table top assembly relative to the surface between a lower position and an upper position with an adjuster that is positioned between the first slider and the second slider, the adjuster acting in push mode to pivot the second leg relative to the first leg to move the table top assembly from the lower position to the upper position, and acts in the pull mode to pivot the second leg relative to the first leg to move the table top assembly from the upper position to the lower position; wherein the adjuster pushes the first slider in a substantially horizontal, linear direction so that the first slider pulls the second slider to move the table top assembly in a substantially vertical upward direction from the lower position to the upper position, and the adjuster pulls the first slider in a substantially horizontal, linear direction so that the first slider pushes the second slider to move the table top assembly in a substantially vertical downward direction from the upper position to the lower position.

11. The method of claim 10 wherein the step of extending includes the first leg having a first leg bottom and the second leg having a second leg bottom, and wherein the step of adjusting includes the step of moving at least one of the first leg bottom and the second leg bottom relative to the surface when moving the table top assembly between the upper position and the lower position.

12. The method of claim 10 wherein the step of adjusting includes the adjuster being positioned adjacent to the table top assembly and above the leg attacher in both the lower position and the upper position of the table top assembly.

13. The method of claim 10 wherein the step of extending includes the steps of pivotably coupling a first leg top of the first leg to the table top assembly, and wherein the step of adjusting includes the step of sliding a second leg top of the second leg relative to the first leg top when the table top assembly moves between the upper position and the lower position.

14. A massage device for supporting a user above a support surface, the massage device comprising:

a table top assembly that supports the user;

a leg assembly that extends between the table top assembly and the surface, the leg assembly including a first leg that is pivotably connected to the table top assembly, a second leg, and a leg attacher that pivotally secures the first leg to the second leg; and an adjuster assembly that adjusts the position of the table top assembly relative to the surface between a lower position and an upper position, the adjuster assembly including (i) a first slider that slides relative to the table top assembly, (ii) a second slider that slidingly connects the second leg to the table top assembly, the second slider being spaced apart from the first slider, (iii) a linkage assembly that couples the first slider to the second slider so that second slider moves concurrently with the first slider, and (iii) an adjuster that selectively and concurrently slides the first slider, the second slider, and the second leg relative to the table top assembly; wherein, the adjuster is positioned between the first slider and the second slider; and wherein the adjuster pushes the first slider and the first slider pulls the second slider to slide the second leg relative to the table top assembly to move the table top assembly from the lower position to the upper position.

15. The massage device of claim 14 wherein the adjuster pushes the first slider relative to the table top assembly to pivot the second leg relative to the first leg to move the table top assembly from the lower position to the upper position, and the adjuster pulls the first slider relative to the table top assembly to pivot the second leg relative to the first leg to move the table top assembly from the upper position to the lower position.

16. The massage device of claim 14 wherein the adjuster pulls the first slider relative to the table top assembly to pivot the second leg relative to the first leg to move the table top assembly from the upper position to the lower position.

17. The massage device of claim 14 wherein the adjuster pulls the first slider and the first slider pushes the second slider to slide the second leg relative to the table top assembly to move the table top assembly from the upper position to the lower position.

18. The massage device of claim 14 wherein the adjuster, the first slider and the second slider are positioned adjacent to the table top assembly and above the leg attacher in both the lower position and the upper position of the table top assembly.

* * * * *